US006912741B1

(12) United States Patent
Noh

(10) Patent No.: US 6,912,741 B1
(45) Date of Patent: Jul. 5, 2005

(54) PARABOLA TYPE AQUEDUCT

(75) Inventor: Shi Youl Noh, Kyonggi-do (KR)

(73) Assignee: FEELUX Co., Ltd., Kyonggi-do (KR)

( * ) Notice: Subject to any disclaimer, the term of this patent is extended or adjusted under 35 U.S.C. 154(b) by 0 days.

(21) Appl. No.: 10/732,789

(22) Filed: Dec. 11, 2003

(51) Int. Cl.[7] ..... E03C 1/04
(52) U.S. Cl. ..... 4/675; 4/619; 239/17; 239/29
(58) Field of Search ..... 4/619, 675–678; 239/17, 22, 29, 32

(56) References Cited

U.S. PATENT DOCUMENTS 3,638,680 A * 2/1972 Kopp ..... 137/606
5,222,672 A * 6/1993 Hart et al. ..... 239/553.5
5,820,022 A * 10/1998 Fukano et al. ..... 239/17
6,276,612 B1 * 8/2001 Hall ..... 239/17

FOREIGN PATENT DOCUMENTS

JP 6-10381 * 6/1994

* cited by examiner

*Primary Examiner*—Charles E. Phillips
(74) *Attorney, Agent, or Firm*—Lee, Hong, Degerman, Kang & Schmasdeka

(57) ABSTRACT

Disclosed is a parabola type aqueduct, which allows water discharged from discharge pipes installed at the top surface of a washstand to fall down to a concave part of the washstand while forming a parabola. The parabola type aqueduct includes: a washstand having a concave part for gathering water to allow a user to use the water, and a drain formed at the bottom of the concave part; a plurality of discharge pipes having a plurality of outlets located at the top surface of the washstand, the discharge pipes allowing water spouting from the outlets to fall down to the concave part of the washstand while forming a parabola; and a plurality of solenoid valves mounted on the discharge pipes respectively for controlling the amount of water spouting through the outlets.

3 Claims, 4 Drawing Sheets

PARABOLA TYPE AQUEDUCT

BACKGROUND OF THE INVENTION

1. Field of the Invention

The present invention relates to a parabola type aqueduct, and more particularly, to a parabola type aqueduct, which can allow water discharged from discharge pipes installed at the top surface of a washstand to fall down to a concave part of the washstand while forming a parabola.

2. Background of the Related Art

In general, at a sink in a kitchen or a washstand in a bathroom, a water tap is installed to supply water supplied from a water source.

FIG. 1 shows a washstand where a conventional water tap is installed.

As shown in FIG. 1, a washstand 1 has a water tap 2 installed at a side of the top surface thereof in such a manner as to be protruded from the top surface thereof by a predetermined height, is installed, and a control lever 3 for controlling the amount of water supplied is installed at a side of the water tap 2. Water spouts out through an outlet 4 formed at an end of the water tap 2 by the control lever 3.

However, in case of the conventional washstand, there has been a problem in that during the spout of water through the outlet 4 of the water tap 2 installed at the washstand 1, water is collided against a concave part of the washstand 1 and splashed to the outside.

Furthermore, if the amount of water is increased, it causes a waste of water as the amount of water splashed to the outside is also increased.

Moreover, the water tap 2 is designed to be protruded to the outside in a predetermined form. So, as the circumference of the water tap 2 is stained with foreign matters, it is not good for sanitary reason and inconvenient in cleaning, and people are restricted in a usable space.

SUMMARY OF THE INVENTION

Accordingly, the present invention has been made to solve the above-mentioned problems, and it is an object of the present invention is to provide a parabola type aqueduct, which allows water discharged from outlets of discharge pipes installed at a washstand to fall down to a concave part of the washstand while forming a parabola.

To achieve the above object, according to the invention, there is provided a parabola type aqueduct includes: a washstand having a concave part for gathering water to allow a user to use the water, and a drain formed at the bottom of the concave part; a plurality of discharge pipes having a plurality of outlets located at the top surface of the washstand, the discharge pipes allowing water spouting from the outlets to fall down to the concave part of the washstand while forming a parabola; and a plurality of solenoid valves mounted on the discharge pipes respectively for controlling the amount of water spouting through the outlets.

Furthermore, ends of the discharge pipes are inclined to allow the outlets to be oriented toward the concave part of the washstand.

Moreover, the solenoid valves are controlled by a sensor type switch part mounted at a side of the top surface of the washstand.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
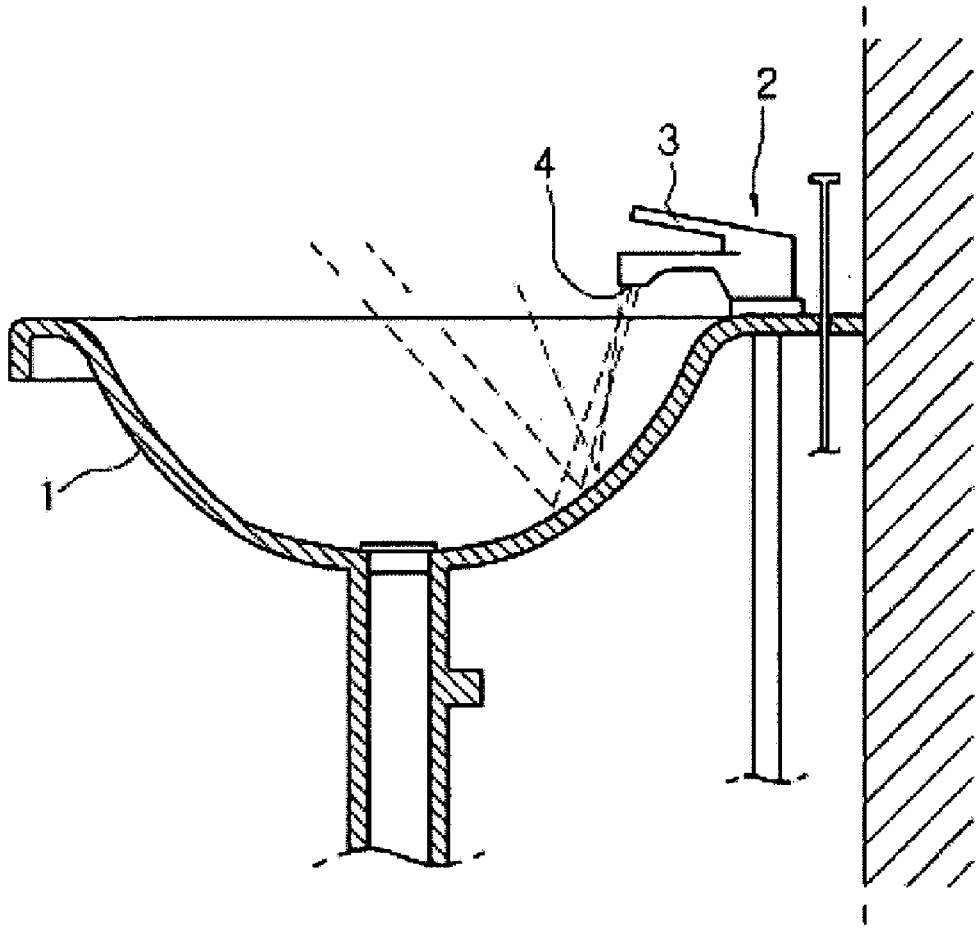
FIG. 1 PRIOR ART
FIG. 1 is a view showing a washstand on where a conventional water tap is installed.
Figure 2:
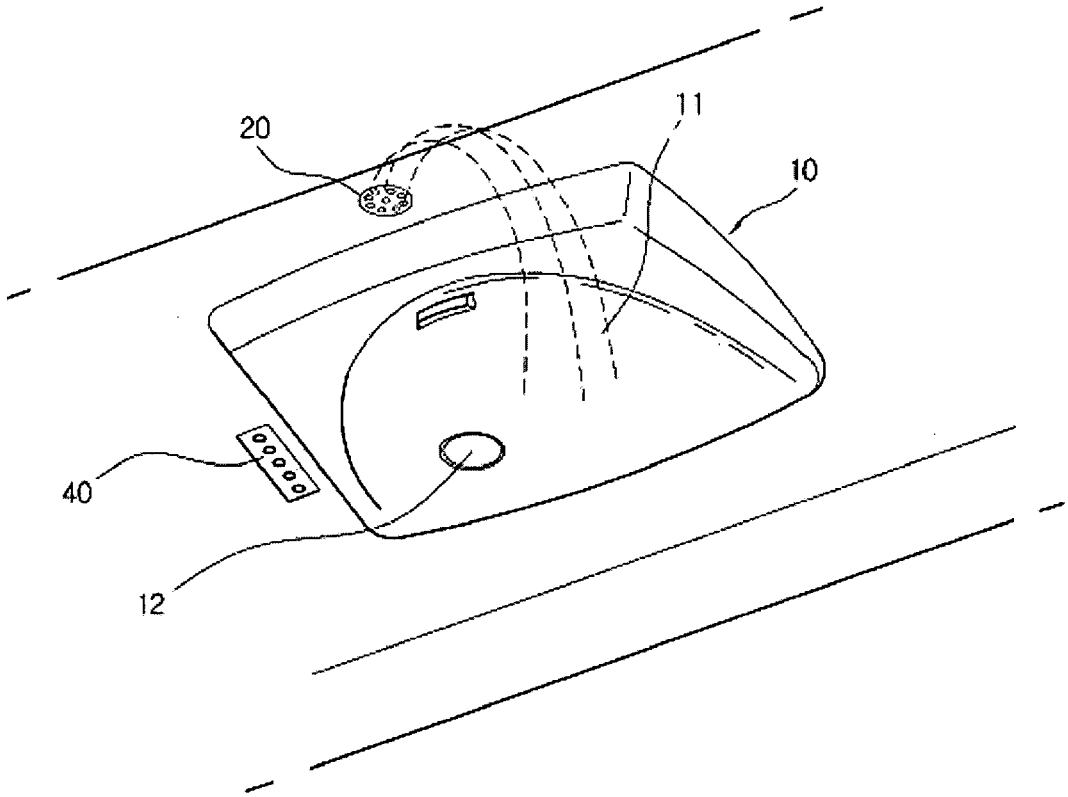
FIG. 2 is a perspective view of a parabola type aqueduct according to the present invention.
Figure 3:
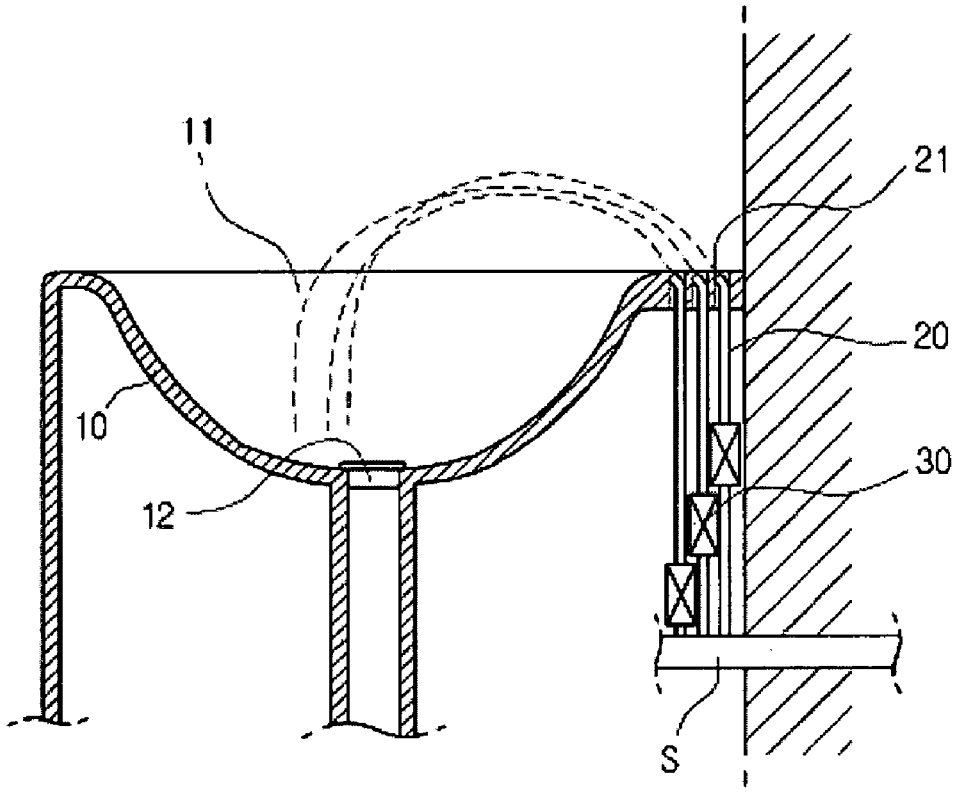
FIG. 3 is a sectional view of the parabola type aqueduct according to the present invention.
Figure 4:
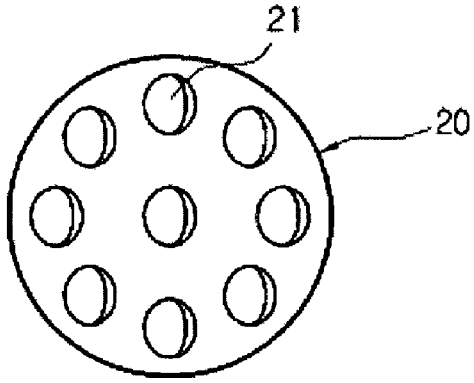
FIG. 4 is a plan view of the parabola type aqueduct according to the present invention.
Figure 5:
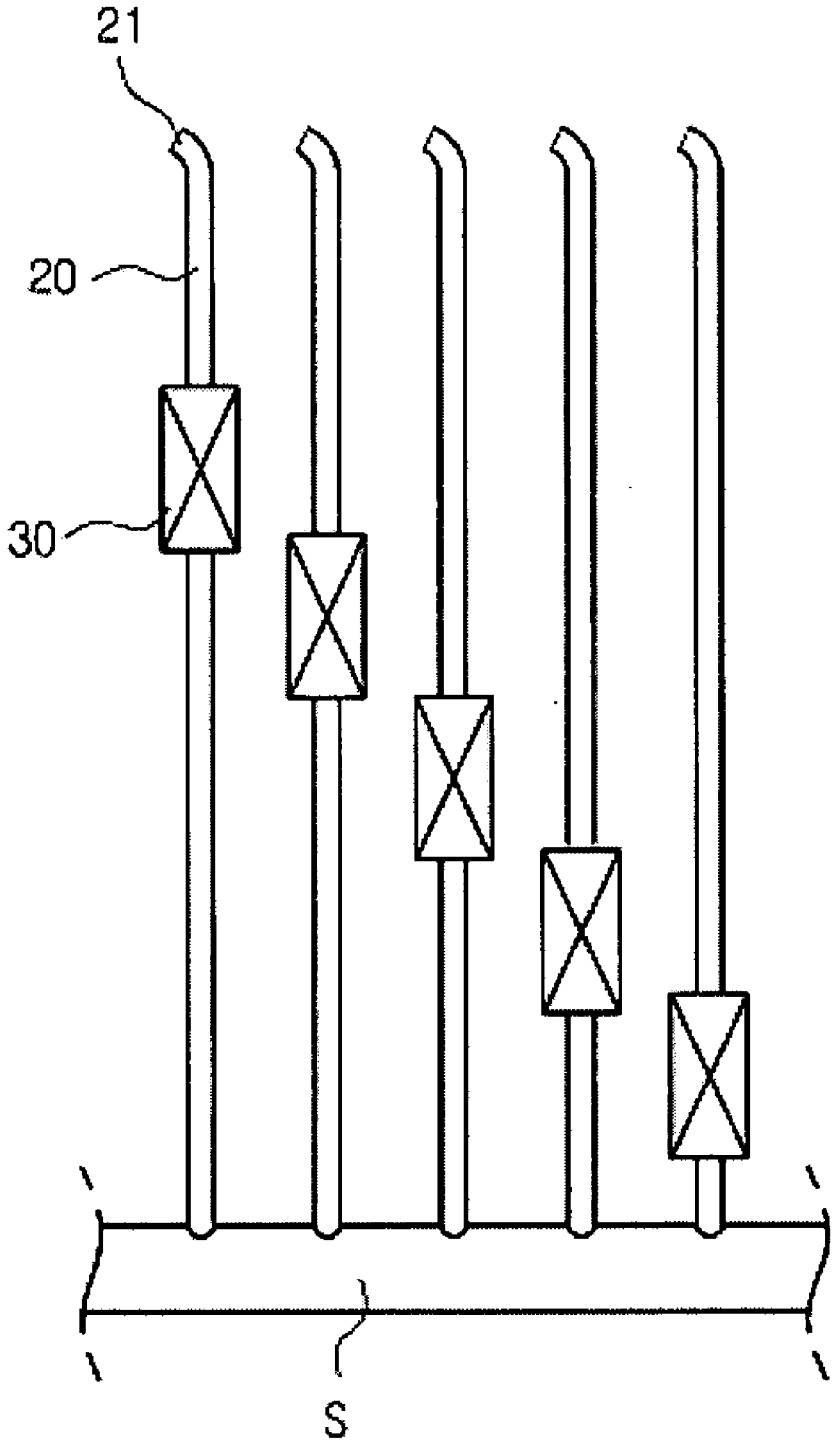
FIG. 5 is view showing a state in which discharge pipes are arranged in a horizontal direction to explain the discharge pipes of the parabola type aqueduct according to the present invention.

FIGS. 2 to 4 show a parabola type aqueduct according to a preferred embodiment of the present invention.

As shown in the drawings, the parabola type aqueduct includes a washstand 10, discharge pipes 20, solenoid valves 30, and a switch part 40.

The washstand 10 is attached and mounted on the wall surface of a bathroom or others. The washstand 10 includes a concave part 11 for gathering water to allow a user to use the water, and a drain 12 formed at the bottom of the concave part 11.

The discharge pipes 20 are mounted upwardly from the lower portion of the washstand 10, for branching water, which is supplied from a water source, from a water supply pipe S. Each of the discharge pipes 20 includes a tubular type solenoid valve 21 mounted thereon, and an outlet 22 located at the top surface of the washstand 10. So, the water spouting from the outlets 22 falls down to the concave part 11 of the washstand 10 while forming a parabola.

Additionally, at this time, it is preferable that a plurality of the discharge pipes 20 are installed to control the amount of water supplied according to opening and closing of the solenoid valves 30.

Furthermore, it is preferable that ends of the discharge pipes 20 are inclined to allow the outlets 22 to face the washstand 10.

The switch part 40 is mounted at a side of the top surface of the washstand 10 to open or close the solenoid valves 30 mounted on the discharge pipes 20.

The switch part 40 is of a sensor type for supplying or interrupting power source through touching of the user's hand, and controls the amount of water supplied by opening and closing the solenoid valves 30, which are mounted on the discharge pipes 20 respectively, in order.

Meanwhile, it is possible that a solenoid valve is mounted on the water supply pipe only, but not on the discharge pipes to control the amount of water discharged to the discharge pipes according to the opening and closing of the solenoid valve.

A function of the present invention will be described in more detail hereinafter.

The parabola type aqueduct according to the present invention includes the discharge pipes 20, which have the solenoid valves 30, and the switch part 40 mounted at the washstand 10 for opening or closing the solenoid valves 30. When the user touches the switch part 40 with a hand, the solenoid valves 30 are opened, and thus, the water spouting through the outlets 22 falls down to the concave part 11 of the washstand 10, so that the user can use it.

As described above, as the water spouting through the outlets 22 freely falls down to the concave part 11 while forming a parabola, the water is not splashed to the outside. Additionally, only the outlets 22 is protruded from the top surface of the washstand 10, and a protruded water tap like a conventional water tap is not provided at the top of the washstand 10, and hence, the parabola type aqueduct according to the present invention is convenient in cleaning and provides the user with a greater usable space.

As described above, the parabola type aqueduct according to the present invention allows the water spouting from the discharge pipes mounted at the washstand to fall down to the concave part of the washstand while forming the parabola, so that the water is not splashed to the outside of the washstand.

Moreover, since only the outlets, but not the conventional water tap are protruded from the top surface of the washstand, the present invention is convenient in cleaning and provides the user with a greater usable space.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A parabola type aqueduct comprising: a washstand having a concave part for gathering water to allow a user to use the water, a top surface adjacent said concave part, and a drain formed at the bottom of the concave part;

a plurality of discharge pipes each having an outlet located in said top surface of the washstand, the discharge pipes providing for water spouting from the outlets to fall down to the concave part of the washstand while forming a parabola; and a solenoid valve mounted on each discharge pipe for controlling the amount of water spouting through each outlet.

2. The parabola type aqueduct according to claim 1, wherein ends of the discharge pipes are inclined to allow the outlets to be oriented toward the washstand.

3. The parabola type aqueduct according to claim 1, wherein the solenoid valves are controlled by a sensor type switch part mounted at a side of the top surface of the washstand.

* * * * *